US012092444B2

(12) United States Patent
Miller

(10) Patent No.: US 12,092,444 B2
(45) Date of Patent: Sep. 17, 2024

(54) EXPANDABLE BROADHEAD

(71) Applicant: TriplePoint Outdoors LLC, Howard, OH (US)

(72) Inventor: Joshua S. Miller, Howard, OH (US)

(73) Assignee: TriplePoint Outdoors LLC, Howard, OH (US)

( * ) Notice: Subject to any disclaimer, the term of this patent is extended or adjusted under 35 U.S.C. 154(b) by 0 days.

(21) Appl. No.: 18/095,141

(22) Filed: Jan. 10, 2023

(65) Prior Publication Data

US 2023/0221100 A1 Jul. 13, 2023

Related U.S. Application Data

(60) Provisional application No. 63/361,586, filed on Jan. 10, 2022.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 4,166,619 A * 9/1979 Bergmann ..... F42B 6/08 473/581
4,579,348 A * 4/1986 Jones ..... F42B 6/08 473/583
4,976,443 A * 12/1990 DeLucia ..... F42B 6/08 473/583
5,458,341 A * 10/1995 Forrest ..... F42B 6/08 473/583
5,564,713 A * 10/1996 Mizek ..... F42B 6/08 473/583
6,830,523 B1 * 12/2004 Kuhn ..... F42B 6/08 473/583
7,377,869 B2 * 5/2008 Wohlfeil ..... F42B 6/08 473/583
7,951,024 B2 * 5/2011 Mizek ..... F42B 6/08 473/583
8,210,972 B2 * 7/2012 Adams ..... F42B 6/08 473/583
9,329,006 B1 * 5/2016 Hansen ..... F42B 6/08
9,377,869 B2 * 6/2016 Tait ..... G06F 3/012
9,945,647 B2 * 4/2018 Pugliese ..... F42B 6/08
9,945,648 B2 * 4/2018 Grace ..... F42B 6/08
10,281,250 B2 * 5/2019 Beck ..... F42B 6/08
10,436,556 B1 * 10/2019 Ohlau ..... F42B 6/08
2006/0084535 A1 * 4/2006 Kuhn ..... F42B 6/08 473/583
2010/0173734 A1 * 7/2010 Robbins ..... F42B 6/08 473/583

* cited by examiner

*Primary Examiner* — John A Ricci
(74) *Attorney, Agent, or Firm* — TaylorIP, P.C.

(57) ABSTRACT

An arrow including a shaft and a broadhead attached to the shaft. The broadhead has a body having a fore section and an aft section and a plurality of pivoting blades pivotally coupled to the body and a magnet. The magnet is coupled to the body in the aft section, the magnet interacting with the plurality of pivoting blades to retain the pivoting blades during flight of the arrow.

16 Claims, 5 Drawing Sheets

EXPANDABLE BROADHEAD

CROSS REFERENCE TO RELATED APPLICATIONS

This is a non-provisional application based upon U.S. provisional patent application Ser. No. 63/361,586, entitled "REAR DEPLOYING MAGNETIC EXPANDABLE BROADHEAD", filed Jan. 10, 2022, which is incorporated herein by reference.

BACKGROUND OF THE INVENTION

1. Field of the Invention

The present invention relates to archery, and, more particularly, to an arrow construct for use in archery, particularly a broadhead having movable parts.

2. Description of the Related Art

There is a continuing interest in archery, which has widespread pre-history origins. The basic instruments are a bow and an arrow. There are various bow configurations historically, and modern bows that have particular advantages. The field of the present invention is focused on the construct of the arrow.

The arrow typically includes a shaft, with an arrowhead affixed to a front portion of the shaft, and fletching and a nock being affixed to a rear portion of the shaft. Modern arrow shafts are typically composed of fiberglass, an aluminum alloy, carbon fiber, or a composite material. The front portion of the shaft may have a threaded feature for the easy attachment of a selected arrowhead.

The arrowhead is the primary functional component of the arrow in that it has a sharpened point or blades designed with the targeted use in mind. Replaceable arrowheads are commonly used and may include target points, field points, and broadheads. Broadheads have various configurations, but generally have a sharpened blade for penetrating the body of a target and providing a path in the body of the target for the outward flow of blood, thereby increasing the effectiveness of the arrow. They usually have two to four sharp blades that cause massive bleeding in the victim. Their function is to deliver a wide cutting edge so as to kill as quickly as possible. There are fixed-blade broadheads and mechanical broadheads. The fixed-blade broadhead has rigid unmovable blades, while the mechanical broadhead deploys its blades upon contact with the target. During a typical deployment its blades swing out to wound the target.

The mechanical head flies better than a fixed-blade broadhead because it is more streamlined, but uses some of the kinetic energy of the traveling arrow to deploy its blades.

What is needed in the art is an efficient broadhead with expanding cutting elements that are retained in the body while in flight to a target.

SUMMARY OF THE INVENTION

The present invention provides a broadhead having deployable blades.

The invention in one form is directed to an arrow including a shaft and a broadhead attached to the shaft. The broadhead has a body having a fore section and an aft section and a plurality of pivoting blades pivotally coupled to the body and a magnet. The magnet is coupled to the body in the aft section, the magnet interacting with the plurality of pivoting blades to retain the pivoting blades during flight of the arrow.

The invention in another form is directed to a broadhead of an arrow. The broadhead has a body having a fore section and an aft section and a plurality of pivoting blades pivotally coupled to the body and a magnet. The magnet is coupled to the body in the aft section, the magnet interacting with the plurality of pivoting blades to retain the pivoting blades during flight of the arrow.

The invention in another form is directed to a method of deploying pivoting blades of a broadhead and include the steps of retaining, propelling, contacting and deploying. The retaining step involves the retaining of the pivoting blades in a slot of a body using a magnet positioned in an aft portion of the body as the magnet exerts an attractive force to an aft portion of the pivoting blades. The propelling step includes the propelling of the arrow with the broadhead attached thereto toward a target. The contacting step includes contacting and piercing the target with wing portions of the pivoting blades. The deploying step includes deploying the pivoting blades due to a lever action of the wing portions, with the deploying overcoming the attractive force of the magnet.

An advantage of the broadhead of the present invention is that the release of the blades from the magnet is consistent.

Another advantage of the broadhead is that the retention of the blades does not require the use of an expendable part, such as an O-ring.

Yet another advantage is that the broadhead can be easily reconfigured into a fixed blade broadhead or as a practice arrow.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
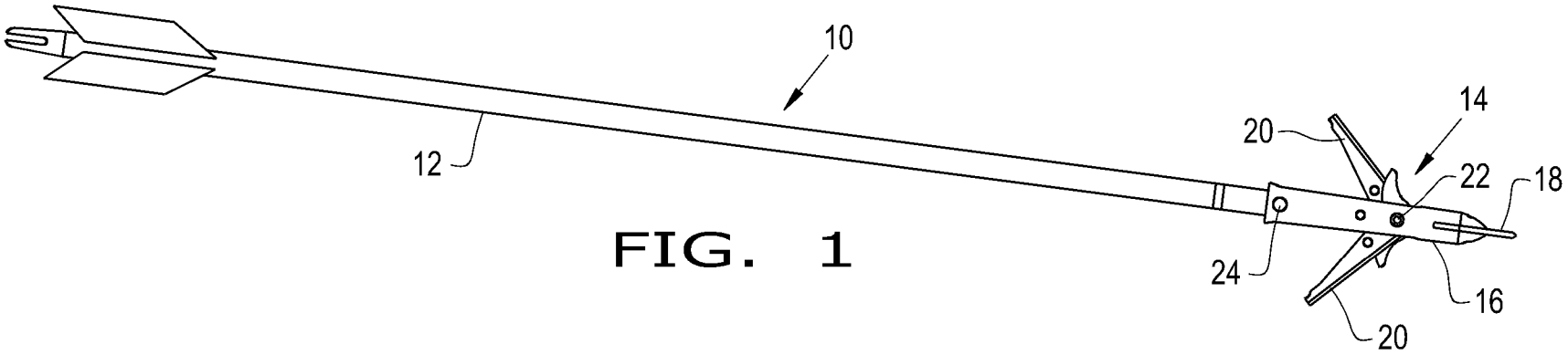
FIG. 1 is a side perspective view of an embodiment of an arrow having a broadhead of the present invention installed on the shaft of the arrow.
Figure 2:
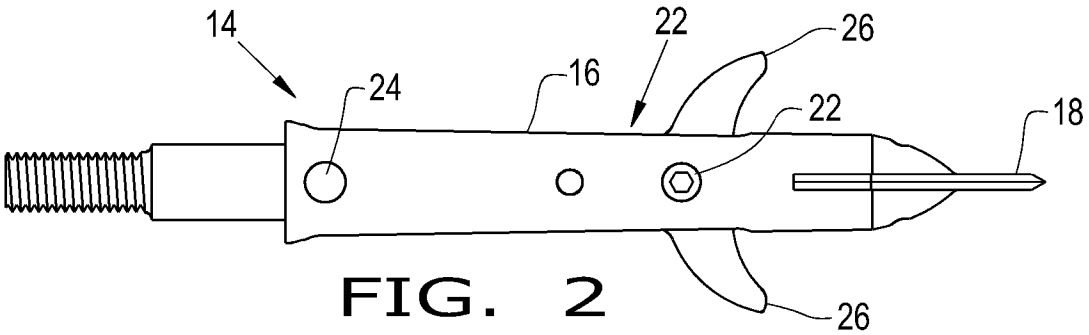
FIG. 2 is a top view of the broadhead of FIG. 1 with the blades folded into the body.

Referring now to the drawings, and more particularly to FIGS. 1 and 2, there is shown an arrow 10 having a shaft 12 and a first embodiment of an expanding broadhead 14 detachably connected to a fore end of shaft 12. The directions referred to as fore and aft correspond to the right and the left of the figures. For example, the orientation of all the figures are such that the typical travel direction of arrow 10 is in the fore direction, to the right side of the illustration.

Broadhead 14 includes a body 16, a tip blade 18, two pivoting blades 20, a pivot coupling 22 and a magnet 24. Body 16 has a through slot that allows pivoting blades 20 to substantially reside in the slot in a retained position, with magnet 24 providing an attractive force to hold pivoting blades 20 in the slot while arrow 10 is in flight. Upon contact with the target, first tip blade 18 starts cutting into the target. Then wing portions 26 of blades 20 contact the surface of the target, which provide a lever force causing an aft end of blades 20 to pivot about pivot coupling 22 to extend outward and in a fore direction. The edges of blades 20 that are moved in the fore direction have sharpened edges. These sharpened edges then encounter the surface of the target and cut into the target.

FIG. 2 is a closer illustration of broadhead 14 with pivoting blades 20 in the retained position. FIG. 1 shows pivoting blades in the extended position, even though they would not be oriented in this manner until contacting a target.

Figure 3:
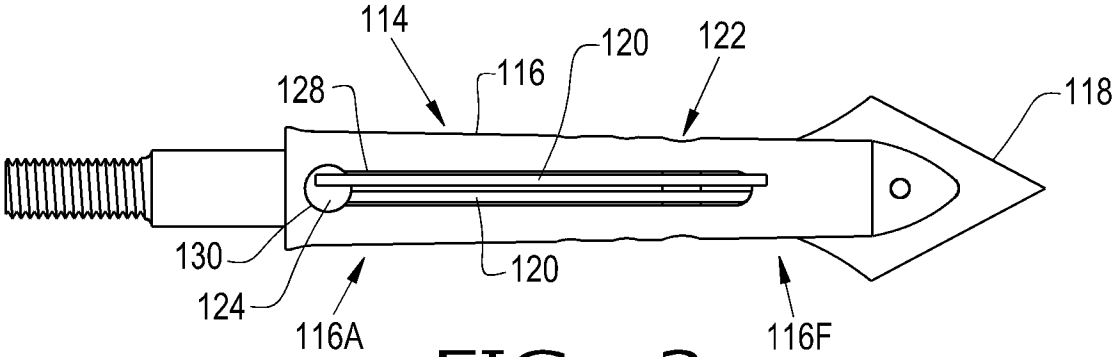
FIG. 3 is a side view of another embodiment of a broadhead of the present invention, which is similar to the broadhead of FIGS. 1 and 2, but with distinctions discussed below.
Figure 4:
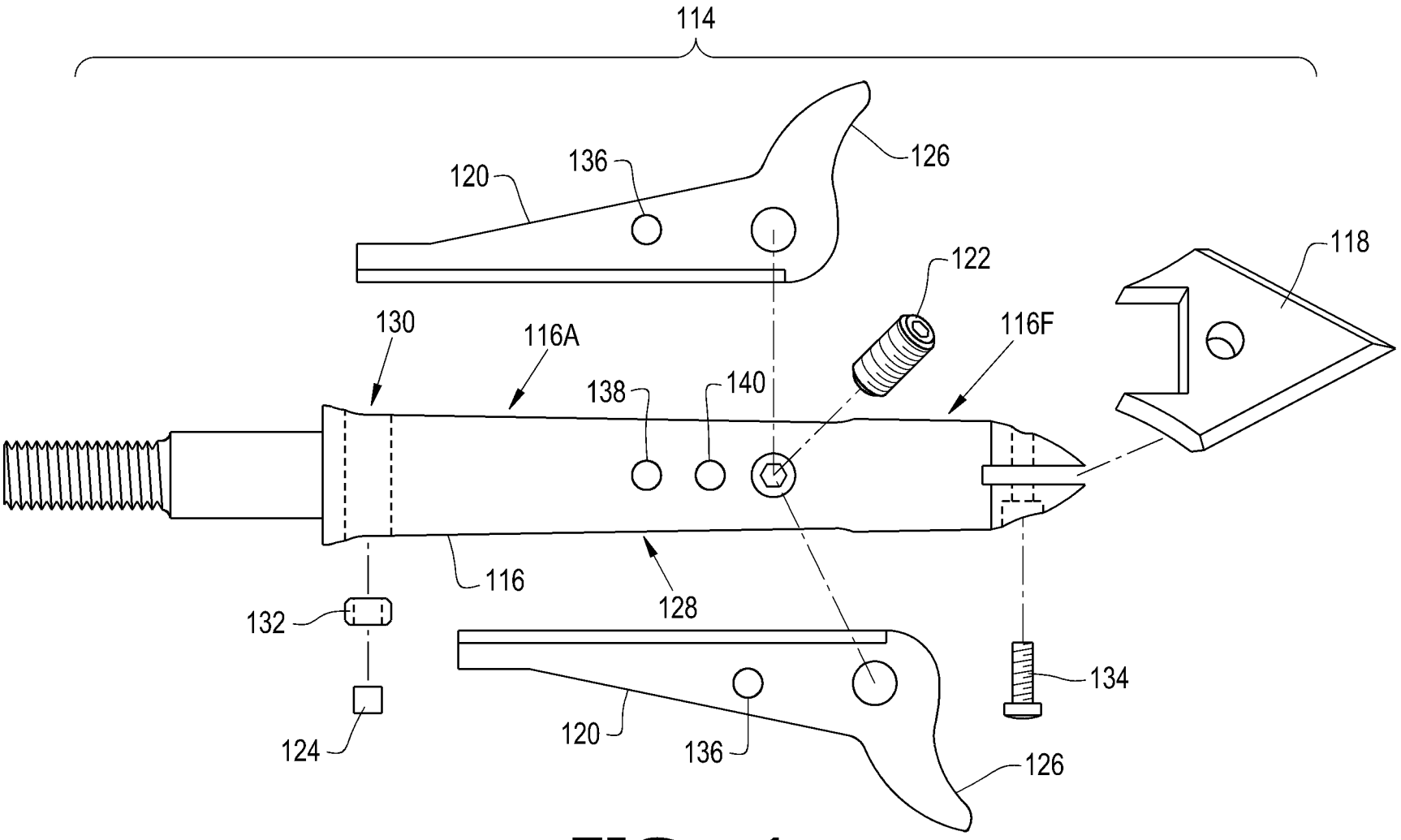
FIG. 4 is an exploded view of the broadhead of FIG. 3.

Now additionally referring to FIGS. 3 and 4, there is shown another embodiment of a broadhead 114 of the present invention, with FIG. 4 being an exploded view. Similar elements of broadhead 114 with those elements of broadhead 14 have numbers that differ from each other by the number 100, for the sake of convenience, and generally the properties of one configuration apply to the other.

Broadhead 114 illustrates a slot 128 and magnet 124 that is, in this embodiment, inserted into a cavity 130, the orientation of which is different from broadhead 14. More specifically, magnet 124 is inserted into a ferule 132, which may be compressible or malleable so as to retain magnet 124 in the desired position in cavity 130. Cavity 130 is at an aft end of slot 128. Tip blade 118 is retained on the fore end of body 116 by way of a screw 134.

Blades 120 include a hole 136 that allows a fastener to be inserted into hole 138, so as to retain blades 120 in slot 128 when force is applied to wings 126. This configuration is useful for practice shots, when it is not desirable for blades 120 to be deployed.

Body 16, 116 has a fore section 116F and an aft section 116A, with pivoting blades 120 pivotally coupled to body 116 about pivot coupling 122. Magnet 124 is coupled to body 116 in aft section 116A. Magnet 124 interacts with pivoting blades 120 to retain pivoting blades 120 in a retracted position during flight of arrow 10. Magnet 124 is positioned with the faces of magnet 124 oriented toward aft ends of blades 120, with magnet 124 being between the aft portions of blades 120, when blades 120 are in slot 128 of body 116. Magnet 124 magnetically interacts with the aft portion of pivoting blades 120 thereby holding blades 120 in the retracted position until a lever force on wings 126 of blades 120 overcome the magnetic interaction, thereby allowing blades 120 to deploy. The lever force on wings 126 occurs when wings 126 are pushed on by a portion of a target. This lever force causes an aft end of pivoting blades 120 to pivot in the fore direction.

Pivoting blades 120 are pivotally coupled to body 116 by way of pivot coupling 122 in the fore section 116F of body 116. Pivot coupling 122 may be in the form of a set screw 122.

Figure 5:
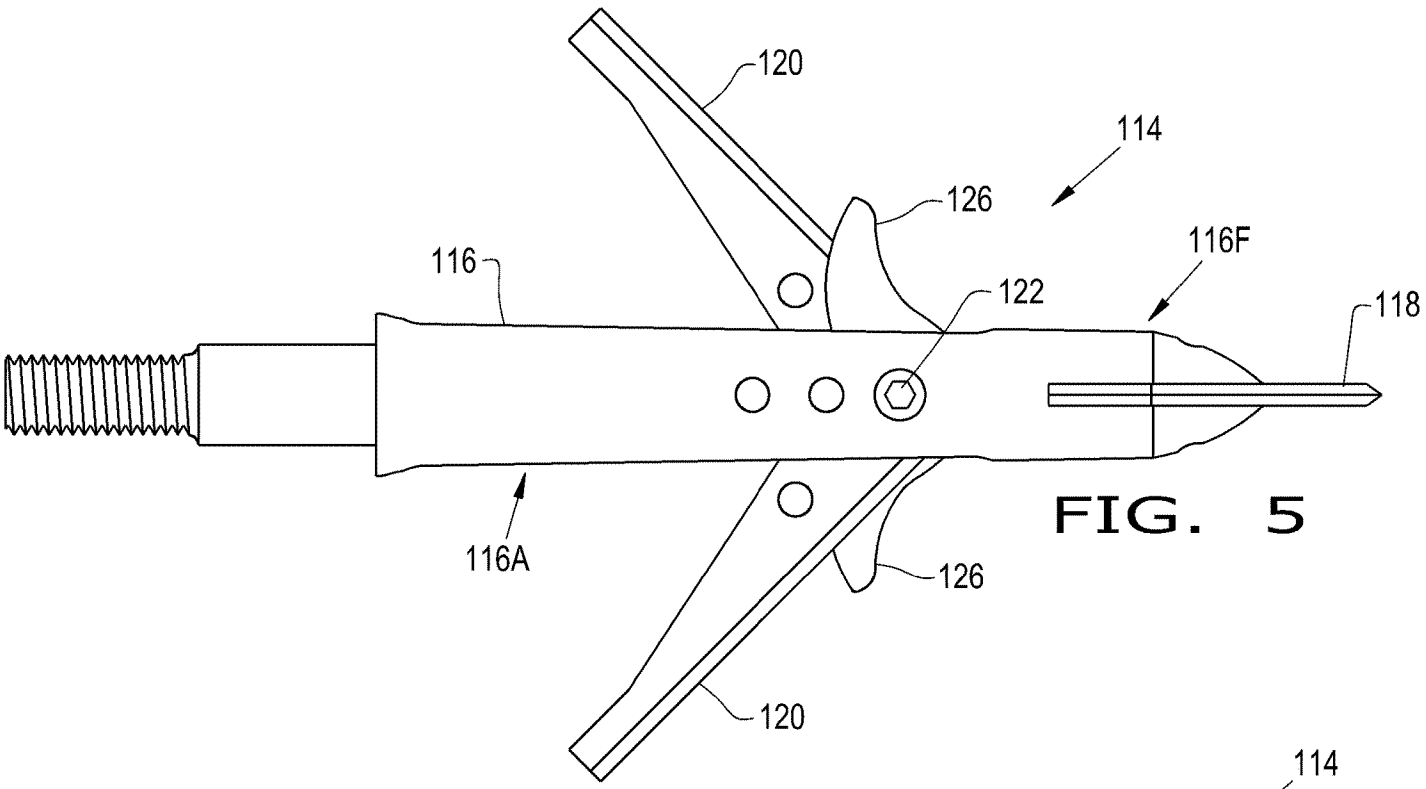
FIG. 5 is a top view of the broadhead of FIGS. 3 and 4, with the blades extended.
Figure 6:
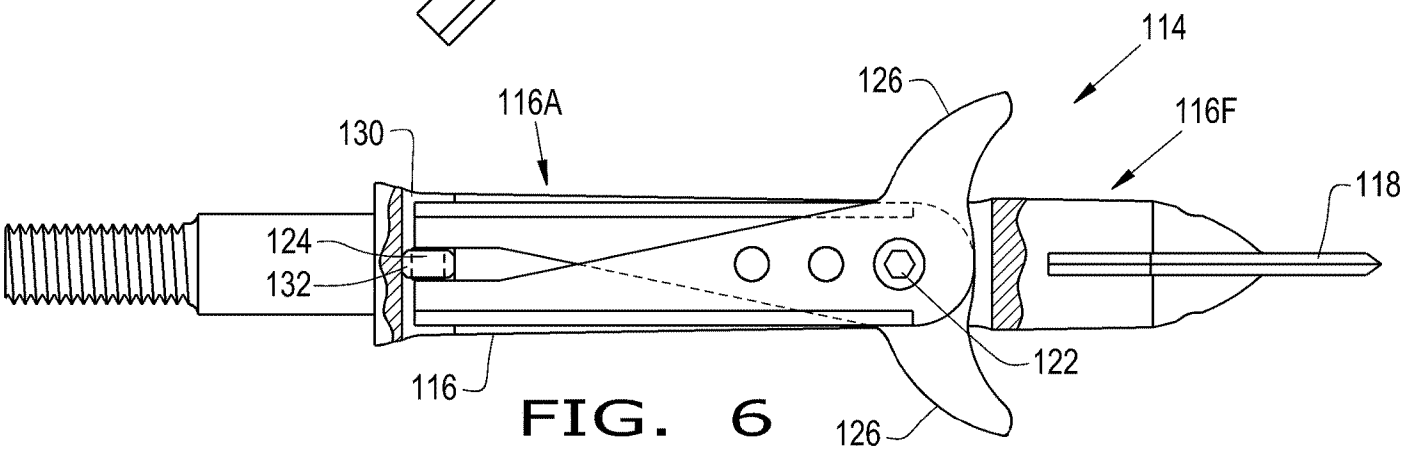
FIG. 6 is a top view of the broadhead of FIGS. 3-5 shown with part of the body removed to show the blades in the retracted position.

Now, additionally referring to FIGS. 5 and 6, there are shown broadhead 114 in the deployed or extended condition (FIG. 5) and the retracted condition (FIG. 6). In FIG. 5, wings 126 are pushed aft causing blades 120 to be deployed, having overcome the magnetic force of magnet 124. In FIG. 6 the positioning of magnet 124 in ferrule 132 within cavity 130 is shown. The faces of magnet 124 are proximate to, or in contact with aft portions of blades 120.

Figure 7:
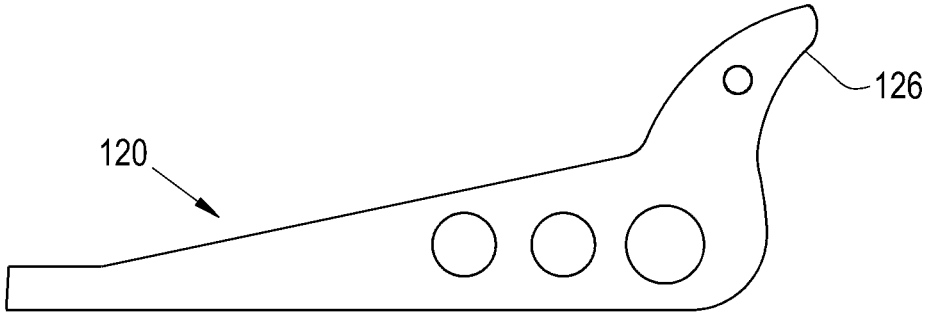
FIG. 7 is a top view of a blade configuration that can be used with the body of the broadheads of FIGS. 1-6.
Figure 8:
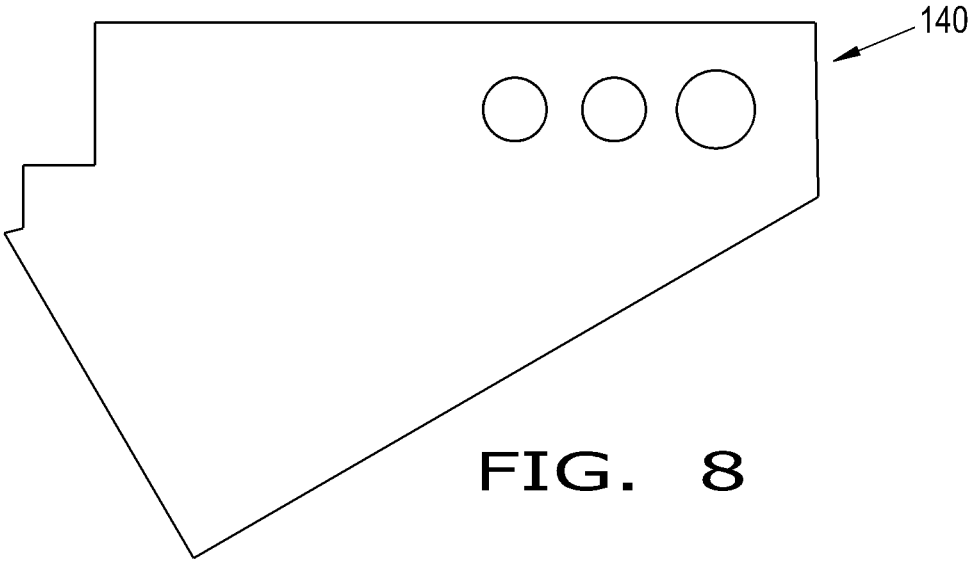
FIG. 8 is a top view of a fixed blade configuration that can be used with the body of the broadheads of FIGS. 1-6.

Now, additionally referring to FIGS. 7 and 8, there is shown a practice blade 120 in FIG. 7, which can be an unsharpened blade 120 and can be configured to be deployable or to be retained by the insertion of screws through holes 138 and 140 of body 116. Blade 140 is a fixed blade 140, two of which can be used in body 116 and secured at 122, 138 and 140. Blades 140 will overlap in slot 128, with slot 128 being slightly larger than twice the thickness of blades 120 or 140.

Figure 9:
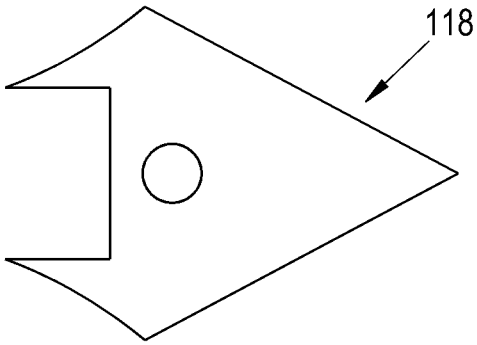
FIG. 9 is a top view of a tip blade configuration that can be used at the front of the body of the broadheads of FIGS. 1-6.
Figure 10:
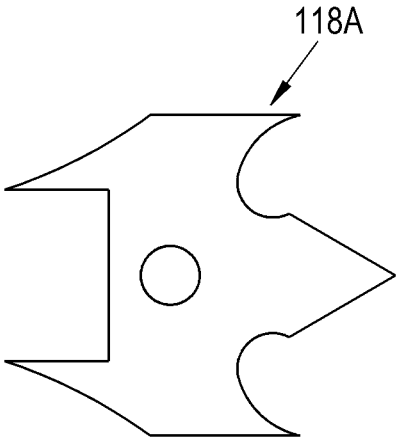
FIG. 10 is a top view of another tip blade configuration that can be used with the body of the broadheads of FIGS. 1-6.

Now, additionally referring to FIGS. 9 and 10, there are shown point blades 118 and 118A, which are alternate points that can be used on the fore of body 116.

Figure 11:
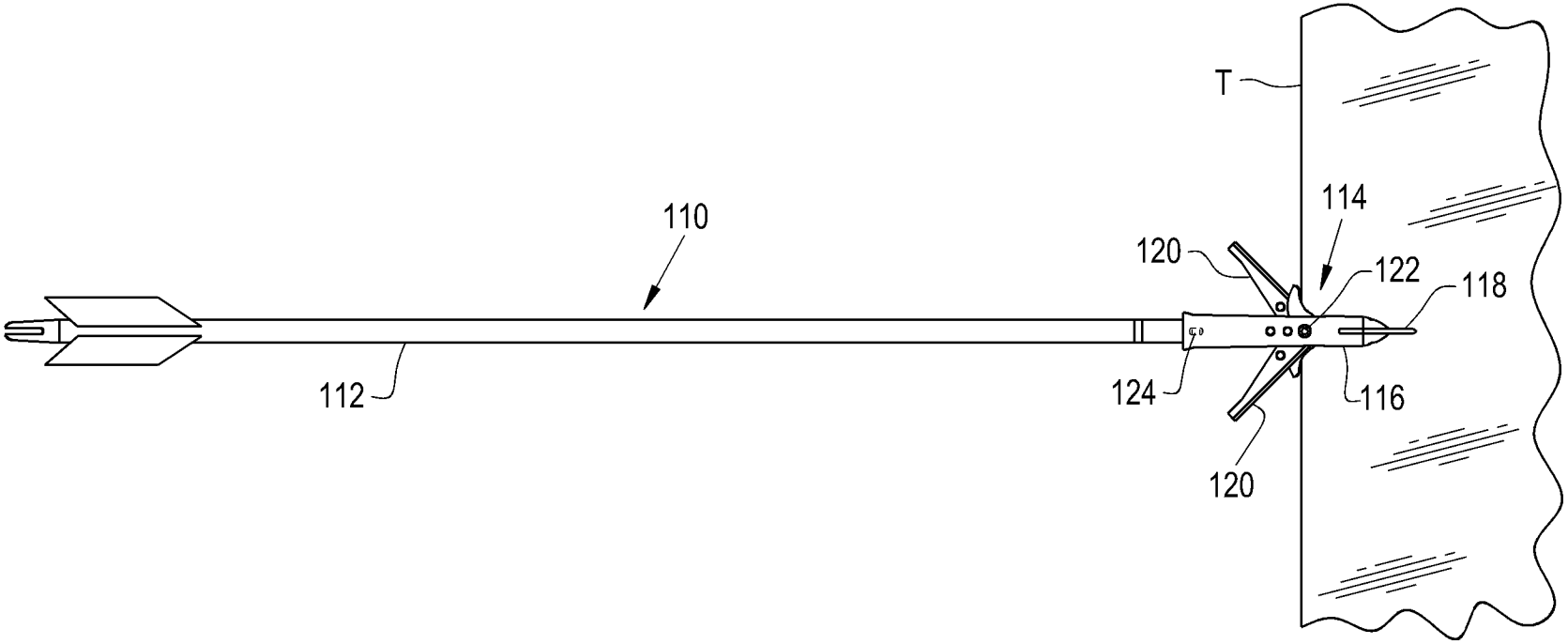
FIG. 11 is a perspective view of an arrow using one of the embodiments of the broadheads illustrated in the figures to illustrate the arrow contacting a target.

Now, additionally referring to FIG. 11 there is shown an arrow 110, that has encountered a target T. This view illustrates the penetration of tip 118 and the deployment of blades 120.

The invention additionally utilizes a method of deploying pivoting blades 120 of broadhead 114 and include the steps of retaining, propelling, contacting and deploying. The retaining step involves the retaining of pivoting blades 120 in slot 128 of body 116 using magnet 124 positioned in an aft portion of body 116 as magnet 124 exerts an attractive force to an aft portion of pivoting blades 120. The propelling step includes the propelling of arrow 110 with broadhead 114 attached thereto toward a target T. The contacting step includes contacting and piercing target T with wing portion 126 of pivoting blades 120. The deploying step includes deploying pivoting blades 120 due to a lever action of wing portions 126, with the deploying overcoming the attractive force of magnet 124.

One of the characteristics of tip 18, 118 is its modularity of design, which allows you to exchange out different tip styles for different hunting purposes. Additionally one can add weights, such as a 25 gm. weight collar to the back of body 16, 116 that slides thereon to change the weight to, for example, 100 gm., 125 gm., 150 gm., or 175 gm. It is also contemplated that single bevel sharpening can be used on tip 18, 118 and cutting blades 20,120 that allow mechanical broadhead 14, 114 to move in a helical fashion after it impacts target T. The blades and tip are sharpened on one side only, so that they can spin right or left in a helical fashion respectively, after arrow 10, 110 impacts target T, cutting large amounts of tissue surface area and splitting open bone to greatly aid in penetration and ethical game harvesting. Additionally, cutting blades 20, 120 have a slap-impact gator style deployment, which leads to large 2"+impact cuts when the blades deploy and large blood trails along with making the harvest even more efficient. Magnet 24, 124 allows cutting blades 20, 120 to stay completely closed at the shot and through the duration of flight in the air, which leads to hyper-precise shots out to 100+ yards when used with the fastest crossbows and vertical bows available.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An arrow, comprising:

a shaft; and a broadhead attached to the shaft, the broadhead including:

a body having a fore section and an aft section;

a plurality of pivoting blades pivotally coupled to the body; and a magnet coupled to the body in the aft section, the magnet interacting with the plurality of pivoting blades to retain the pivoting blades in a retracted position during flight of the arrow, wherein the magnet has two faces, with one face directed to an aft portion of one pivoting blade and the other face being directed toward an aft portion of a second pivoting blade of the plurality of pivoting blades, wherein the magnet is between the aft portions of the pivoting blades when the pivoting blades are substantially in the body.

2. The arrow of claim 1, wherein the pivoting blades are pivotally coupled to the body in the fore section of the body.

3. The arrow of claim 1, wherein the broadhead further includes a tip point fixed to the fore section of the body.

4. The arrow of claim 1, wherein the magnet is positioned in a shaped cavity in the aft section of the broadhead.

5. The arrow of claim 4, wherein the body has a slot within which the pivoting blades substantially reside until the arrow contacts a target.

6. The arrow of claim 5, wherein the shaped cavity is connected to an aft portion of the slot.

7. The arrow of claim 1, wherein the magnet magnetically interacts with a portion of the pivoting blades thereby holding the blades in the retracted position until a lever force on the blades overcome the magnetic interaction.

8. The arrow of claim 7, wherein the lever force occurs when wings of the pivoting blades are pushed on by a portion of a target.

9. The arrow of claim 8, wherein the lever force causes an aft end of the pivoting blades to pivot in the fore direction.

10. A broadhead for an arrow, the broadhead comprising:

a body having a fore section and an aft section;

a plurality of pivoting blades pivotally coupled to the body; and a magnet coupled to the body in the aft section, the magnet interacting with the plurality of pivoting blades to retain the pivoting blades in a retracted position substantially within the body during flight of the arrow, wherein the magnet is between aft portions of the pivoting blades when the pivoting blades are substantially in the body.

11. The broadhead of claim 10, wherein the magnet is positioned in a shaped cavity in the aft section of the broadhead, the body has a slot within which the pivoting blades substantially reside until the arrow contacts a target, wherein the shaped cavity is connected to an aft portion of the slot.

12. The broadhead of claim 10, wherein the magnet magnetically interacts with a portion of the pivoting blades thereby holding the blades in the retracted position until a lever force on the blades overcome the magnetic interaction.

13. The broadhead of claim 10, wherein the lever force occurs when wings of the pivoting blades are pushed on by a portion of a target.

14. A method of deploying pivoting blades of a broadhead, comprising the steps of:

retaining pivoting blades in a slot of a body of the broadhead using a magnet positioned in an aft portion of the body, the magnet exerting an attractive force to an aft portion of the pivoting blades;

propelling an arrow with the broadhead attached thereto toward a target;

contacting the target with a wing portion of the pivoting blades; and deploying the pivoting blades due to a lever action of the wing portion, the deploying overcoming the attractive force, wherein the magnet is positioned in a shaped cavity in the aft section of the broadhead, wherein the shaped cavity is connected to an aft portion of the slot, wherein the lever action causes an aft end of the pivoting blades to pivot in a fore direction, wherein the magnet has two faces, with one face directed to an aft portion of one pivoting blade and the other face being directed toward an aft portion of a second pivoting blade of the plurality of pivoting blades.

15. The method of claim 14, wherein the magnet is compressively held in the body.

16. The method of claim 14, wherein the magnet is between the aft portions of the pivoting blades when the pivoting blades are substantially in the body.

* * * * *